United States Patent [19]

Tatham

[11] 4,008,653

[45] Feb. 22, 1977

[54] DIFFUSER

[75] Inventor: Walter A. Tatham, Tucson, Ariz.

[73] Assignee: Lear Siegler, Inc., Santa Monica, Calif.

[22] Filed: Dec. 4, 1974

[21] Appl. No.: 529,356

[52] U.S. Cl. ..... 98/40 D; 98/108

[51] Int. Cl.[2] ..... F24F 13/08

[58] Field of Search ..... 98/40 C, 40 D, 40 V, 98/108, 40 DL

[56] References Cited

UNITED STATES PATENTS

| | | | |
|---|---|---|---|
| 2,655,857 | 10/1953 | Broberg | 98/40 V |
| 2,902,919 | 9/1959 | Waalkes et al. | 98/40 C |
| 3,274,916 | 9/1966 | Waeldner et al. | 98/40 D |
| 3,299,797 | 1/1967 | Dry | 98/40 DL |
| 3,310,672 | 3/1967 | Bursell | 98/40 DL X |
| 3,319,558 | 5/1967 | Bodian | 98/40 D |
| 3,343,476 | 9/1967 | Dominguez | 98/40 C |
| 3,655,837 | 9/1972 | Balfanz, Jr. | 98/40 D |
| 3,703,140 | 11/1972 | Gutheim | 98/40 D |
| 3,811,369 | 5/1974 | Ruegg | 98/40 D |

*Primary Examiner*—William E. Wayner
*Assistant Examiner*—William E. Tapolcai, Jr.
*Attorney, Agent, or Firm*—Cahill, Sutton & Thomas

[57] ABSTRACT

A diffuser is disclosed incorporating a plenum chamber adapted for mounting upon the T bars utilized to support ceiling tile in a suspended ceiling structure. The plenum chamber includes an elongated opening along the bottom thereof to permit conditioned air to escape from the plenum into the room below. A pattern controller is mounted in the plenum and includes a longitudinally extending sheet having a continuously curved surface extending from one edge of the opening upwardly into the plenum to adjustably partially block the flow of air through the opening. The portion of the sheet adjacent the edge of the plenum is offset to lower the exit surface of the sheet so that the curved surface extends downwardly to or below the surface of the ceiling.

4 Claims, 3 Drawing Figures

DIFFUSER

The present invention pertains to diffusers and more particularly to diffusers known as slot diffusers for use in distributing conditioned air.

Modern commercial construction usually incorporates acoustical or sound absorbing tile ceilings which are suspended on supports having a cross-sectional shape of an inverted T. Air distribution into rooms having such a ceiling is usually facilitated through supply ducts that feed plenum chambers either supported on the T bars or suspended by wires in a manner similar to T bars. In many installations, proper air distribution dictates the use of elongated slots as the means for introducing the air into the room through the plenum chamber. Such prior art slot diffusers present difficulties when it is desired that the air exiting therefrom travel along the ceiling rather than downwardly from the slot.

The utilization of directing plates or deflectors in the slots is usually accompanied by impairment of the capability of the diffuser to handle relatively large volumes of air efficiently and quietly. Further, the structures tend to be complicated when the deflectors are designed to be adjustable to permit the adjustment of the volume rate of flow through the slot or to permit adjustment of the direction of discharge of the air through the slot.

It is therefore an object of the present invention to provide a slot diffuser incorporating a pattern controller that can efficiently handle large volumes of air with minimum noise and pressure.

It is another object of the present invention to provide a slot type diffuser that permits the efficient control of the air exiting from the diffuser and permits the air to efficiently be directed along the ceiling.

It is still another object of the present invention to provide a slot diffuser having a pattern controller that effectively permits the volume of air passing through the diffuser to readily be adjusted through a relatively wide range without seriously effecting the efficiency of the diffuser.

It is still another object of the present invention to provide a slot diffuser incorporating a pattern controller that may easily be adjusted for volume rate of flow in the field and can also be reversed in the field to direct the flow from the diffuser parallel to and adjacent the ceiling in either of two principal directions.

These and other objects of the present invention will become apparent to those skilled in the art as the description thereof proceeds.

The present invention may be more readily understood by reference to the accompanying drawings in which.

Figure 1:
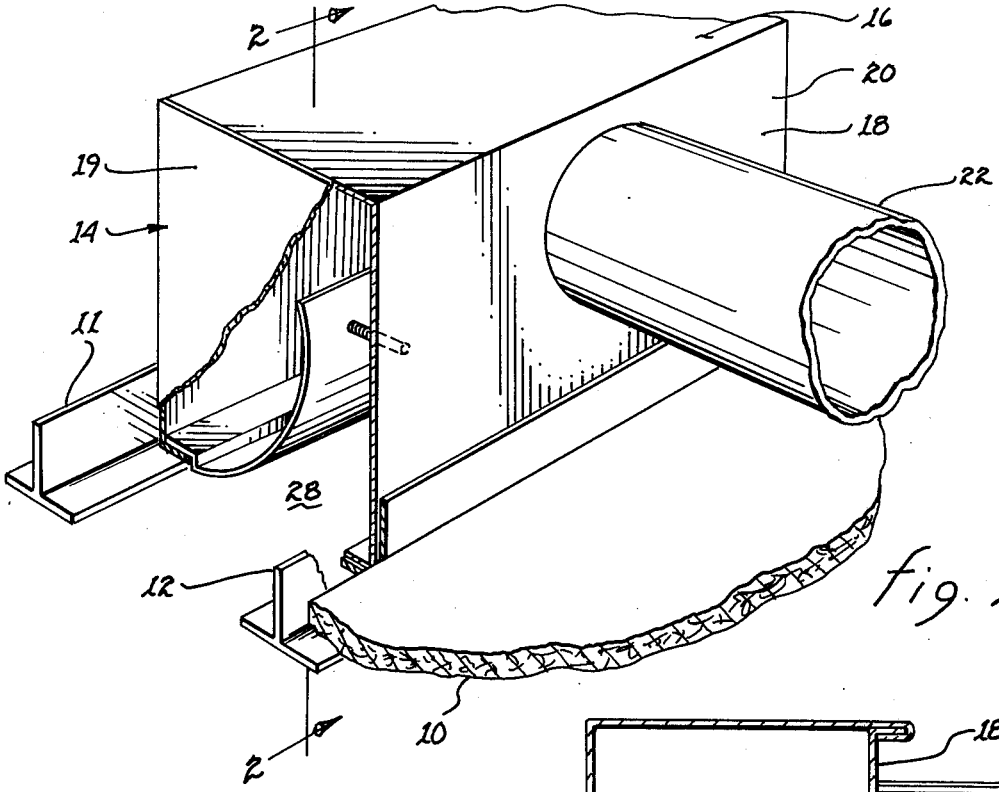
FIG. 1 is a perspective view, partly in section, of a portion of a suspended ceiling showing a diffuser constructed in accordance with the teachings of the present invention mounted above the ceiling.

Referring to the drawings, a typical ceiling tile 10 is shown supported by conventional T bars, such as 11 and 12, which in turn are suspended in any convenient manner such as by wires (not shown) from the true ceiling above the room to be conditioned. The T bars

11 and 12 may be spaced a conventional distance apart to act as supports for a plenum 14. Alternatively, the plenum may be suspended from the true ceiling of the room in a manner similar to that of the T bars 11 and 12.

The plenum 14 includes a top 16, sides 17 and 18 as well as end walls 19 and 20; obviously, the plenum may take other configurations although the shape shown is the most convenient. The wall 18 is provided with an inlet duct 22 for connection to a suitable source of conditioned air (not shown). In the embodiment chosen for illustration, the bottom of the plenum 14 is formed with two opposing lips 24 and 26 spaced apart to form an elongated opening 28 which opening may conveniently correspond in width to the distance between the bottom of the T bars 11 and 12.

A pattern controller 30, which may be of sheet metal, is mounted in the plenum 14 and is coextensive in length with the length of the elongated opening 28. The lower longitudinally extending portion of controller 30 is upset as shown at 32 to provide a supporting platform 33 integral therewith and to provide a continuously curved surface 34 extending from the lowermost edge 35 of the controller 30 to its uppermost edge 36. The lowermost edge 35 extends down at least to the bottom surfae 37 of the T bar 11. The edge 35 may extend lower than the surface 37, it being important only to insure that the edge is even with or below the surface of the suspended ceiling of the room or any obstructions adjacent to the elongated opening 28.

The controller 30 is supported along its upper portion by one or more adjusting screws 40 that may threadedly engage a nut 41 braised or welded to the controller 30. The adjusting screw is in abutting contact with the wall 18 of the plenum 14 so that the controller 30 may be pivoted to enlarge or decrease the area of the opening 43 between the surface 34 and the wall 18.

Figure 2:
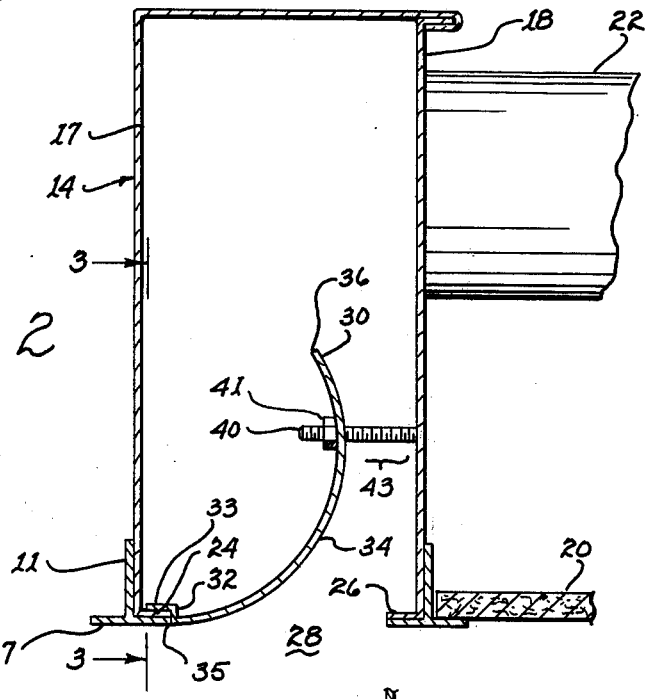
FIG. 2 is a cross-sectional view of FIG. 1 taken along line 2—2.
Figure 3:
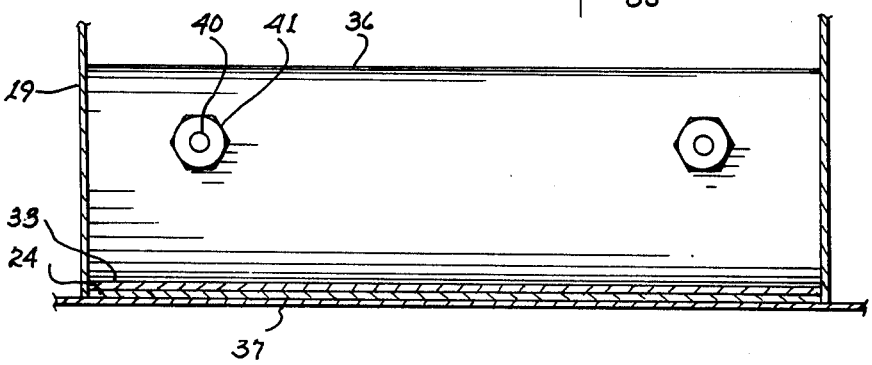
FIG. 3 is a cross-sectional view of FIG. 2 taken along line 3—3.

In operation, conditioned air is admitted through the inlet supply duct 22 into the interior of the plenum 14. The air escapes from the plenum by exiting through the area defined by the length of the plenum and the width of the opening 43; the escaping air follows the smooth contoured surface 34 and is therefore ejected substantially parallel to the surface of the adjacent ceiling. The air is directed to the left (as in FIG. 2) or may be directed to the right by removing the controller 30 and reversing the orientation thereof by placing the supporting platform 33 on the lip 26.

The flow rate or volume rate of flow of conditioned air exiting from the plenum 14 may therefore be controlled by adjusting the screw 40. This adjustment may be easily carried out in the field; further, the controller 30 may easily be removed from the plenum 14 and replaced in a reversed position to direct air exiting through the elongated opening 28 along the ceiling adjacent the diffuser to the left, as in FIG. 2, or to the right. The positioning of the edge 35 even with or below the bottom surface 37 of the T bar provides a smoothly contoured surface 34 for the exiting air throughout the entire length of the diffuser to guide the airstream along the ceiling without disruption that would otherwise occur if the air flow were interrupted by obstacles or protrusions in its path adjacent the slot 28.

It may therefore be seen that by incorporating the upset in the controller 30, the air flow over the surface 34 is guided from the plenum to the room without vortex generation and results in efficient air flow and significant sound reduction. The design of the present invention also provides the alternative use of the diffuser as a vertical air diffuser by simply removing the controller and permitting the air to escape the elongated opening 28 without obstruction.

I claim:

1. A diffuser for controllably discharging air into a room through an elongated ceiling opening comprising:

a. a plenum adapted to be supported above said ceiling over said ceiling opening, said plenum including means for receiving conditioned air to be distributed to said room.

b. said plenum having an elongated opening for alignment with said elongated ceiling opening;

c. an elongated sheet mounted in said plenum, said sheet extending the length of, and being supported along, and in continuous contact with said elongated opening and having an edge positioned below said elongated opening and extending along said ceiling opening, said sheet including a continuously curved convex surface extending upwardly from said edge into said plenum;

d. means preventing air in said plenum from flowing over other than the convex surface through said elongated ceiling opening; and e. said sheet forming a continuous air guiding surface extending from within said plenum to a position at least even with said ceiling.

2. The combination set forth in claim 1 wherein said plenum is a rectangular box having two side walls, a top wall, and end walls, and having said elongated opening in the bottom thereof and including a pair of opposed lips each extending from adjacent said elongated opening to a different one of said side walls, said sheet including a longitudinally extending offset extending upwardly from said edge and including means defining a supporting platform formed integrally with said offset and contacting one of said lips for supporting said sheet.

3. The combination set forth in claim 2 including adjusting means for adjustably positioning said sheet in said plenum comprising means contacting one of said side walls and said sheet to maintain a predetermined spacing therebetween.

4. The combination set forth in claim 3 wherein said adjusting means threadedly engages said sheet and abutts said side wall.

* * * * *